US011259612B2

(12) United States Patent
Peng

(10) Patent No.: US 11,259,612 B2
(45) Date of Patent: Mar. 1, 2022

(54) POWER CORD DETACHABLE STRUCTURE FOR PORTABLE HAIR CURLER

(71) Applicant: Dongguan Lisi Intelligent Technology Co., Ltd, Guangdong (CN)

(72) Inventor: Jinhu Peng, Guangdong (CN)

(73) Assignee: Dongguan Lisi Intelligent Technology Co., Ltd, Guangdong (CN)

( * ) Notice: Subject to any disclaimer, the term of this patent is extended or adjusted under 35 U.S.C. 154(b) by 0 days.

(21) Appl. No.: 17/169,573

(22) Filed: Feb. 8, 2021

(65) Prior Publication Data

US 2021/0161269 A1 Jun. 3, 2021

Related U.S. Application Data

(63) Continuation-in-part of application No. 16/655,278, filed on Oct. 17, 2019, now Pat. No. 10,944,195.

(30) Foreign Application Priority Data

Sep. 3, 2019 (CN) ..... 201910828380.0

(51) Int. Cl.
*A45D 1/04* (2006.01)
*H01R 13/52* (2006.01)
(Continued)

(52) U.S. Cl.
CPC ..... *A45D 1/04* (2013.01); *H01R 13/5205* (2013.01); *H01R 33/06* (2013.01); *H01R 35/04* (2013.01)

(58) Field of Classification Search
CPC ..... H01R 13/5841; H01R 13/562; H01R 13/5205; H01R 35/04; H01R 33/06; A45D 1/04
(Continued)

(56) References Cited

U.S. PATENT DOCUMENTS 3,953,098 A 4/1976 Avery et al.
4,357,519 A * 11/1982 Bain, Jr. ..... D06F 75/28 174/46
(Continued)

FOREIGN PATENT DOCUMENTS

CN 102544899 7/2012
CN 106936008 7/2017
(Continued)

OTHER PUBLICATIONS

"Office Action of Japan Counterpart Application", dated Apr. 13, 2021, p. 1-p. 3.
(Continued)

*Primary Examiner* — Gary F Paumen
(74) *Attorney, Agent, or Firm* — JCIP Global Inc.

(57) ABSTRACT

The disclosure discloses a novel power cord detachable structure for portable hair curler, including a power cord, an encapsulation is fixed to one end of the power cord, and an upper handle is fixed to the top of the encapsulation. By providing a fixing slot on the fixing sleeve and inserting the fixing sleeve into the appliance, the fixing sleeve is rotated to loose and fasten the fastener, thereby achieving the detaching effect. By providing and pushing the tail sleeve, the internal rotary lock is opened, the power cord is inserted into the product, the tail sleeve is loosened, and the fixing point inside the tail sleeve returns to the position where the lock is pushed, so that the power cord will not be detached. The tail sleeve is pushed so that the internal rotary lock is opened, and the power cord can be pulled out smoothly.

6 Claims, 8 Drawing Sheets

(51) Int. Cl.
*H01R 35/04* (2006.01)
*H01R 33/06* (2006.01)

(58) Field of Classification Search
USPC ..... 439/446, 534
See application file for complete search history.

(56) References Cited

U.S. PATENT DOCUMENTS

| | | | | |
|---|---|---|---|---|
| 4,863,396 | A * | 9/1989 | Johnson | H01R 13/508 439/470 |
| 7,481,673 | B1 | 1/2009 | Qu et al. | |
| 7,544,085 | B2 * | 6/2009 | Baldwin | H01R 13/5829 439/471 |
| 7,837,495 | B2 * | 11/2010 | Baldwin | H01R 13/5804 439/459 |
| 2003/0082942 | A1 | 5/2003 | Wlos | |
| 2011/0059641 | A1 * | 3/2011 | Hu | H01R 13/6275 439/345 |
| 2012/0312319 | A1 * | 12/2012 | Uwano | A45D 2/001 132/211 |
| 2017/0013931 | A1 * | 1/2017 | Chen | A45D 1/28 |
| 2021/0289908 | A1 * | 9/2021 | Lo | A45D 20/12 |

FOREIGN PATENT DOCUMENTS

| | | |
|---|---|---|
| CN | 206714345 | 12/2017 |
| CN | 207638045 | 7/2018 |
| CN | 110444976 | 11/2019 |
| CN | 111109807 | 5/2020 |
| EP | 2301376 | 3/2011 |
| JP | S58185102 | 12/1983 |
| KR | 20170108796 | 9/2017 |

OTHER PUBLICATIONS

"Search Report of Europe Counterpart Application", dated Sep. 10, 2021, p. 1-p. 10.

* cited by examiner

POWER CORD DETACHABLE STRUCTURE FOR PORTABLE HAIR CURLER

CROSS-REFERENCE TO RELATED APPLICATION

This application is a continuation-in-part application of and claims the priority benefit of a prior application Ser. No. 16/655,278, filed on Oct. 17, 2019, which claims the priority benefits of China Application No. 201910828380.0, filed on Sep. 3, 2019. The entirety of each of the above-mentioned patent applications is hereby incorporated by reference herein and made a part of this specification.

BACKGROUND

Field of the Disclosure

The disclosure relates to the technical field of hairdressing products, in particular to a novel power cord detachable structure for portable hair curler.

Description of Related Art

Currently, there are many kinds of electrical appliances for hairdressing, which have different functions according to different hairdressing effects, such as: curling irons, straightening combs, curling combs, hair irons, hair dryers, electric hot-air combs, hair straightener or similar products. The electrical adapters of these existing appliances are typically fixed to the power cord slot through the housing, and the electrical adapters cannot be disassembled, which makes it inconvenient to place and carry the appliances.

SUMMARY OF THE DISCLOSURE

The purpose of the disclosure is to provide a novel power cord detachable structure for portable hair curler, so as to solve the above-mentioned problem that the electrical adapters of these existing appliances are typically fixed to the power cord slot through the housing, and the electrical adapters cannot be disassembled, which makes it inconvenient to place and carry the appliances.

In order to achieve the above purpose, the disclosure provides the following technical solutions: a novel power cord for portable hair curler, including a power cord, an encapsulation fixed to one end of the power cord, an upper handle fixed to the top of the encapsulation, a lower handle fixed to the bottom at one side of the encapsulation, a decorative cover engaged between the lower handle and the upper handle, a CC plug fixed to the other end of the power cord. One end of the power cord passes through the encapsulation and is fixedly connected to one end of the tail ring. A first electronic wire is fixed at both sides of the tail ring. An outer circular contact piece and a circular pin contact piece are fixed at both sides of the tail ring. The middle portion at one side of the encapsulation is connected to a detachable structure.

In a preferred technical solution of the disclosure, the detachable structure is composed of a first power cord lower pushing cover and a first power cord upper pushing cover. One side of the first power cord upper pushing cover is fixedly connected to the first power cord lower pushing cover through a screw. An internal plug is fixedly configured at the connection between the encapsulation and the tail ring.

In a preferred technical solution of the disclosure, the detachable structure consists of a first conductive base, a first conductive pin, a first fixing sleeve, a first rotary lock, two second conductive pins, a first pin holder and four second electronic wires. The first conductive base is fixedly provided at one side of the power cord. The first conductive copper ring is sleeved at the connection between the power cord and the first conductive base. The first conductive pin is fixedly provided at one side of the first conductive base. The first fixing sleeve is rotatably connected to one end of the first conductive pin. The first rotary lock is rotatably connected to one side of the first fixing sleeve. The second conductive pin is fixed at both ends at one side of the first rotary lock. The top of the two second conductive pins are fixedly connected to both ends at the bottom of the first pin holder. The second electronic wire is fixedly provided at both ends at the top of the first pin holder and both sides of the inner wall of the first fixing sleeve. The first fixing sleeve consists of the second power cord upper pushing cover and the second power cord lower pushing cover. One side of the second power cord upper pushing cover is fixedly connected to one end of the second power cord lower pushing cover through a screw.

In a preferred technical solution of the disclosure, the detachable structure is composed of a conductive piece, a second conductive base, a third conductive pin, two fourth conductive pins, a second pin holder, and a second fixing sleeve. The conductive sheet is fixedly provided at one side of the power cord. The second conductive base is fixedly provided at one side of the conductive sheet. The third conductive pin is fixedly provided at the top of the second conductive base. Both sides at the other end of the third conductive pin are respectively fixedly connected to one end of the two fourth conductive pins. The other end of the two fourth conductive pins are respectively fixedly connected to the both ends of the bottom of the second pin holder. The second fixing sleeve is rotatably connected to the outer side of the second pin holder. The second fixing sleeve is composed of the third power cord upper pushing cover and the third power cord lower pushing cover. One side of the third power cord upper pushing cover is fixedly connected to one end of the third power cord lower pushing cover through a screw. One side of the upper handle and one side of the lower handle are provided with a fixed button. Both sides of the inner wall of the decorative cover are provided with a fixed fastener. A first spring is fixed between the two fasteners.

In a preferred technical solution of the disclosure, the detachable structure is composed of a tail sleeve, a second rotary lock, a second spring and a fifth conductive pin. The second rotary lock is fixed at one end of the tail sleeve. The second rotary lock is fixedly connected to one end of the fifth conductive pin through the second spring. A power switch is engaged between the lower handle and the upper handle. Both ends of the bottom of the power switch are fixedly connected to both ends at the top of tail contact terminal through the electronic lead. A fastening spring is fixed at the connection between the encapsulation and the second rotary lock. The conductive copper sleeve is fixed at the connection between the encapsulation and the tail ring. The second conductive copper ring is fixed at the internal portion of the conductive copper sleeve.

In a preferred technical solution of the disclosure, the encapsulation is in a gun shape or a linear shape.

Compared with the related art, the disclosure has the following advantageous effects. By providing a fixing slot on the fixing sleeve and inserting the fixing sleeve into the appliance, the fixing sleeve is rotated to the fixing and limiting position to achieve the fastening effect. The fixing sleeve is rotated to loose and fasten the fastener, thereby achieving the detaching effect. By providing and pushing the tail sleeve, the internal rotary lock is opened, the power cord is inserted into the product. The tail sleeve is loosened, and the fixing point inside the tail sleeve returns to the position where the lock is pushed, so that the power cord will not be detached. The tail sleeve is pushed so that the internal rotary lock is opened, and the power cord can be pulled out smoothly, thereby achieving the detaching effect. The internal structure is optimized, the elastic ring parts can be reduced, and the assembly process can be optimized.

DESCRIPTION OF EMBODIMENTS

The following will explicitly and thoroughly describes the technical solutions in the embodiments of the disclosure in conjunction with the accompanying drawings in the embodiments of the disclosure. Clearly, the described embodiments are only a part of the embodiments of the disclosure, but not all the embodiments. Based on the embodiments of the disclosure, all other embodiments obtained by those of ordinary skill in the art without making inventive effort shall fall within the scope of the disclosure.

Figure 1:
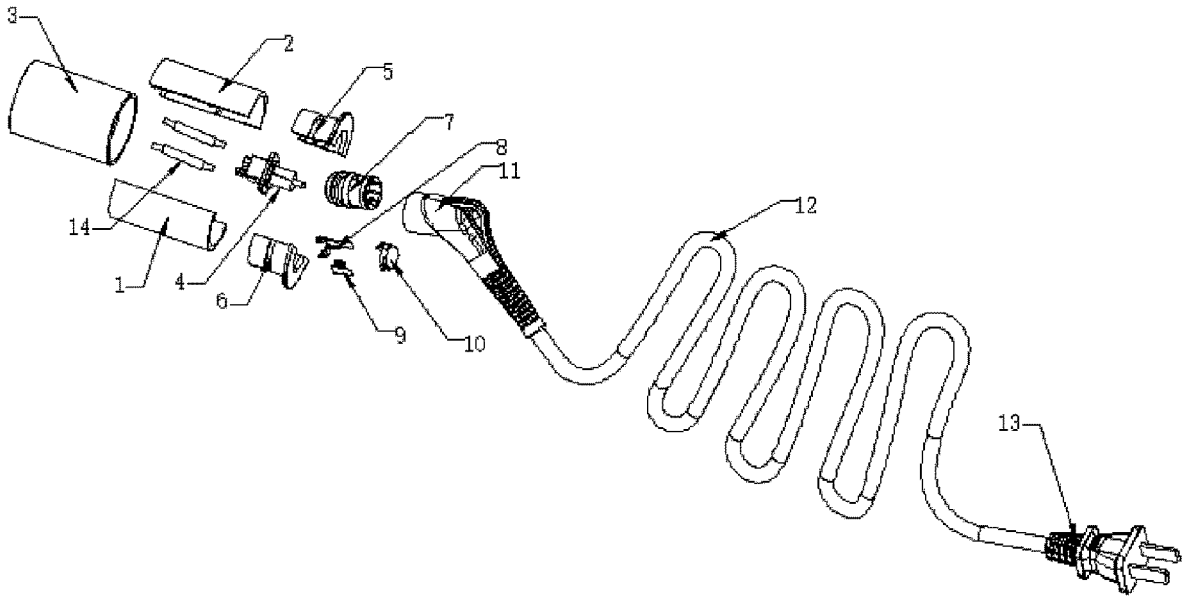
FIG. 1 is a perspective view of Embodiment 1 of the disclosure.
Figure 2:
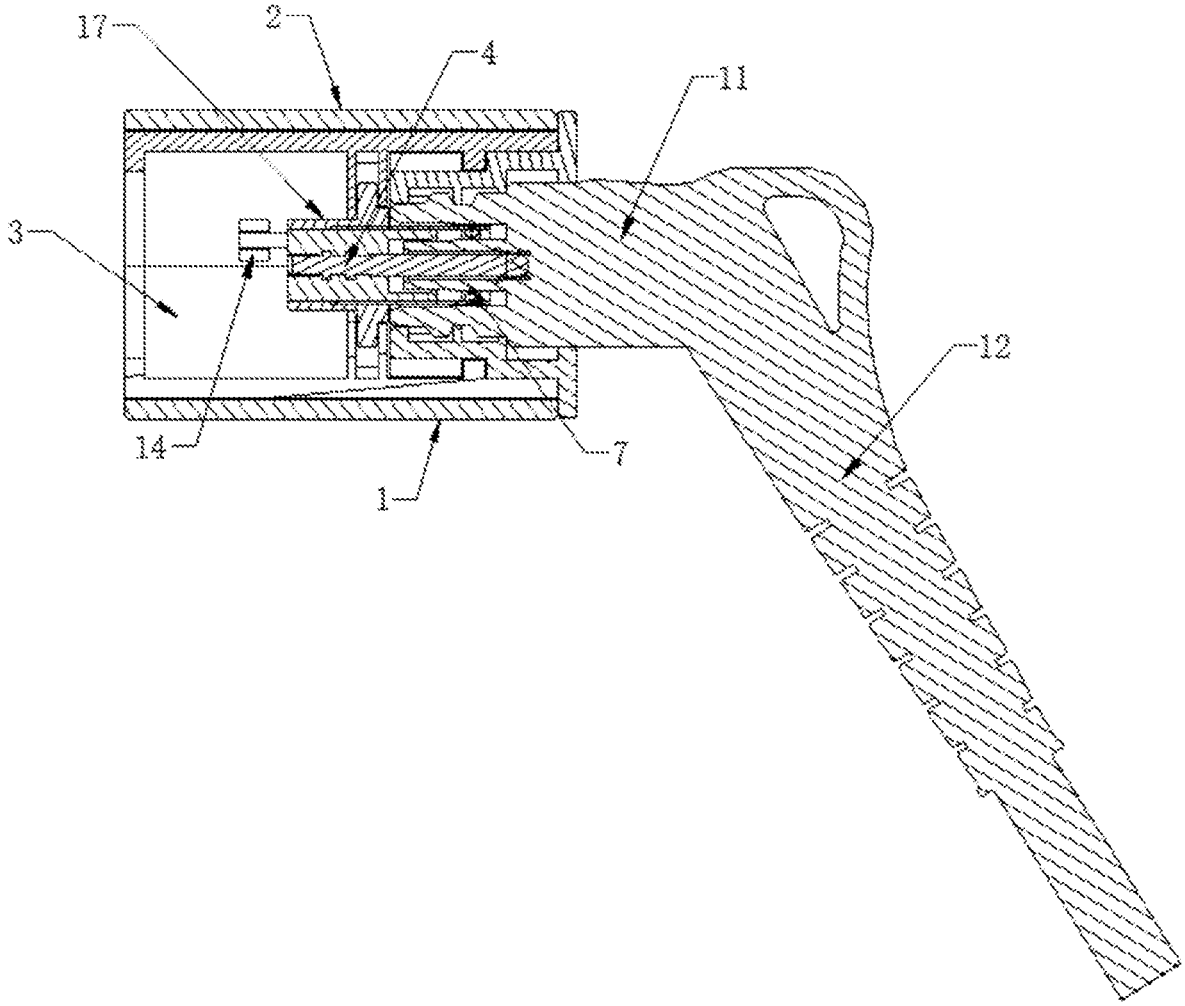
FIG. 2 is a cross-sectional side view of Embodiment 1 of the disclosure.
Figure 3:
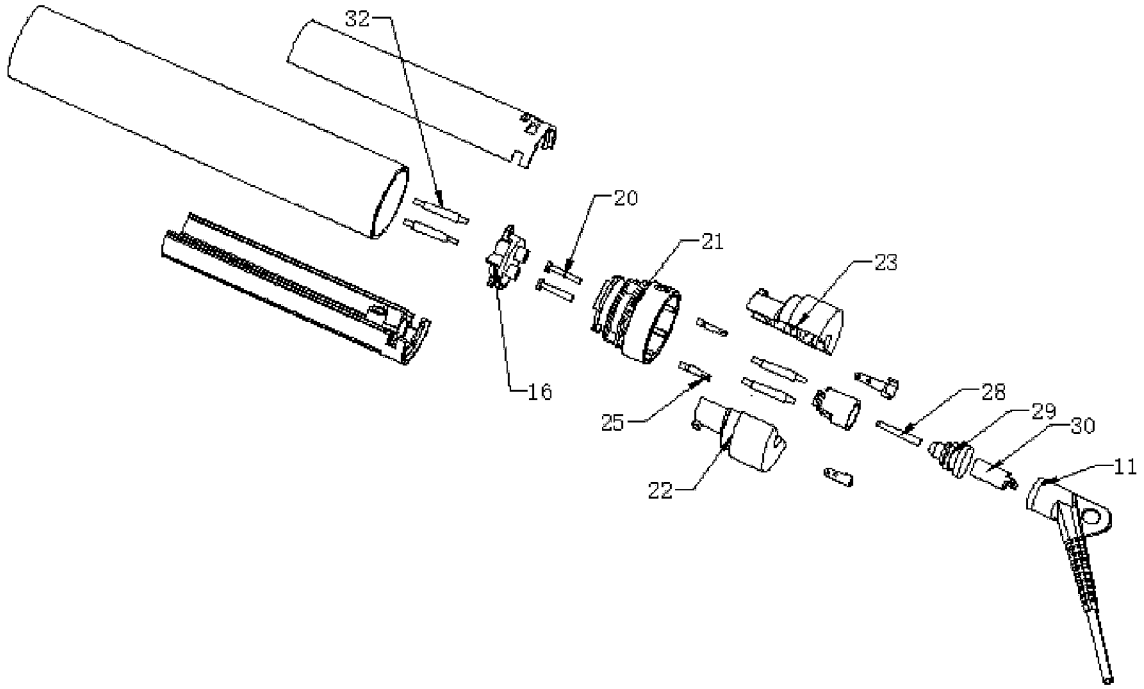
FIG. 3 is a perspective view of Embodiment 2 of the disclosure.
Figure 4:
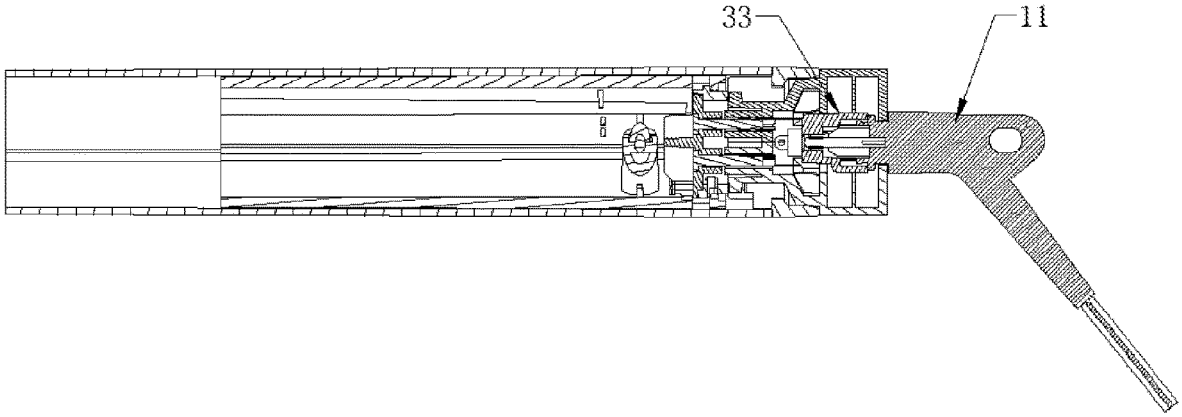
FIG. 4 is a cross-sectional side view of Embodiment 2 of the disclosure.
Figure 5:
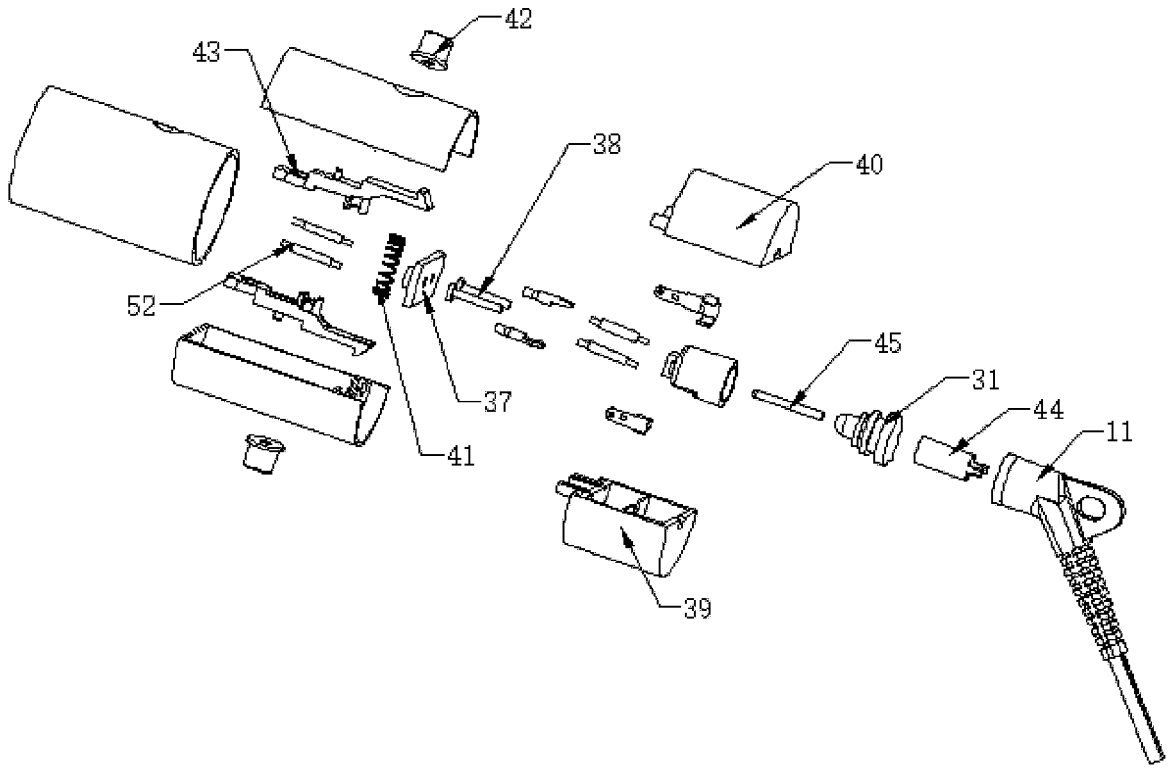
FIG. 5 is a perspective view of Embodiment 3 of the disclosure.
Figure 6:
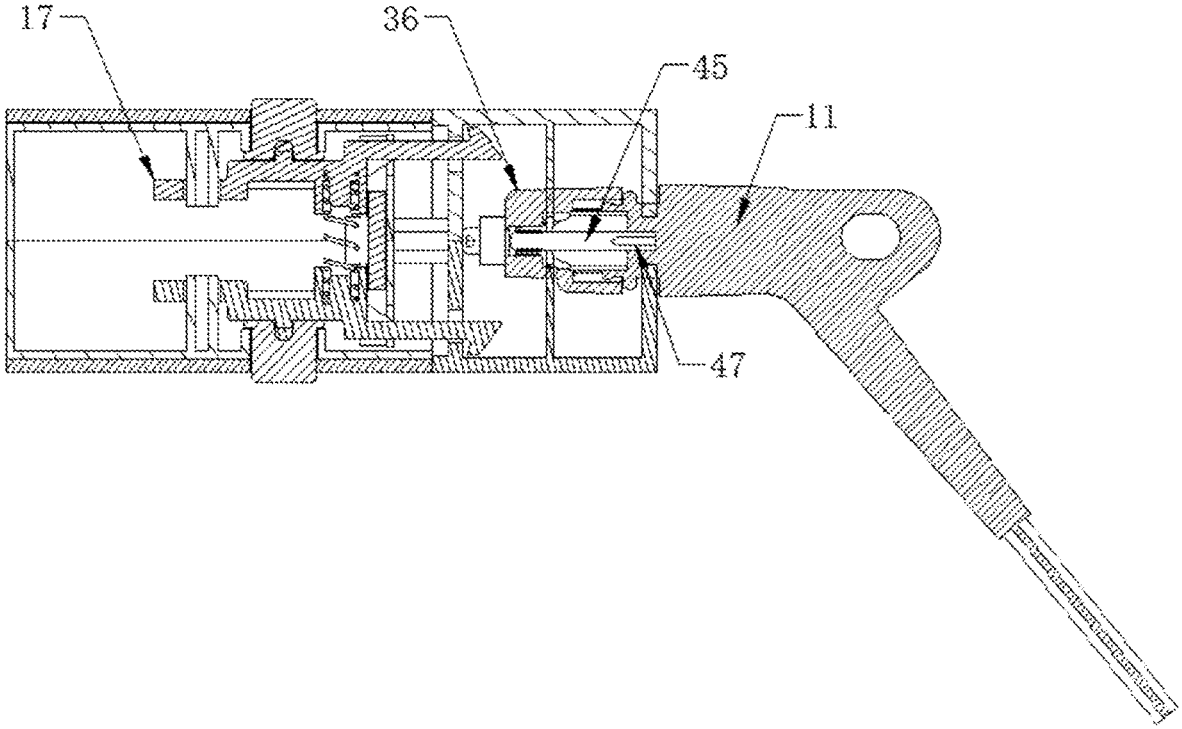
FIG. 6 is a cross-sectional side view of Embodiment 3 of the disclosure.
Figure 7:
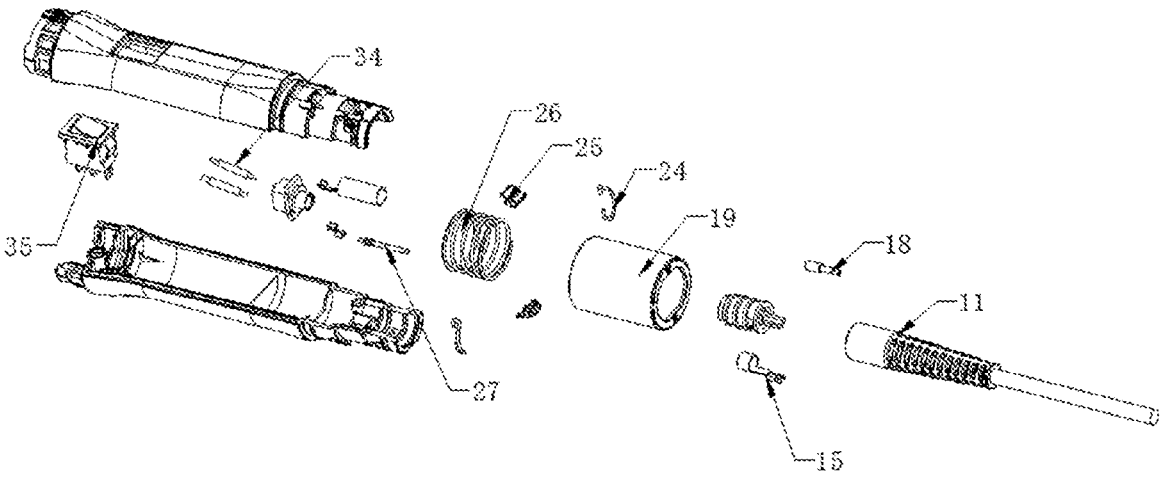
FIG. 7 is a perspective view of Embodiment 4 of the disclosure.
Figure 8:
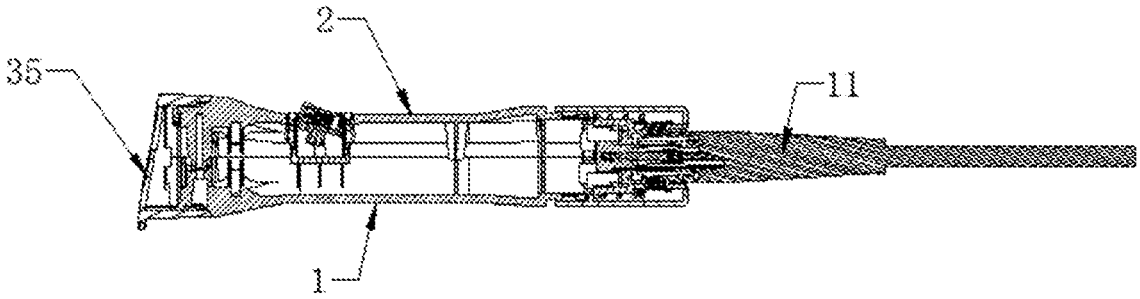
FIG. 8 is a cross-sectional side view of Embodiment 4 of the disclosure.

Please refer to FIG. 1 to FIG. 8. The disclosure provides a novel power cord detachable structure for portable hair curler, including a power cord 12, an encapsulation 11 fixed to one end of the power cord 12, an upper handle 2 fixed to the top of the encapsulation 11, a lower handle 1 fixed to the bottom at one side of the encapsulation 11, a decorative cover 3 engaged between the lower handle 1 and the upper handle 2, a CC plug 13 fixed to the other end of the power cord 12. One end of the power cord 12 passes through the encapsulation 11 and is fixedly connected to one end of the tail ring 7. A first electronic wire 14 is fixed at both sides of the tail ring 7. An outer circular contact piece 8 and a circular pin contact piece 9 are fixed at both sides of the tail ring 7. The middle portion at one side of the encapsulation 11 is connected to a detachable structure 17.

Preferably, the detachable structure 17 is composed of a first power cord lower pushing cover 6 and a first power cord upper pushing cover 5. One side of the first power cord upper pushing cover 5 is fixedly connected to the first power cord lower pushing cover 6 through a screw. An internal plug 10 is fixedly configured at the connection between the encapsulation 11 and the first tail ring 7. By providing the internal plug 10, the tightness at the connection can be enhanced.

Preferably, the detachable structure 17 consists of a first conductive base 29, a first conductive pin 28, a first fixing sleeve 33, a first rotary lock 21, two second conductive pins 20, a first pin holder 16 and four second electronic wires 32. The first conductive base 29 is fixedly provided at one side of the power cord 12. The first conductive copper ring 30 is sleeved at the connection between the power cord 12 and the first conductive base 29. The first conductive pin 28 is fixedly provided at one side of the first conductive base 29. The first fixing sleeve 33 is rotatably connected to one end of the first conductive pin 28. The first rotary lock 21 is rotatably connected to one side of the first fixing sleeve 33. The second conductive pin 20 is fixed at both ends at one side of the first rotary lock 21. The top of the two second conductive pins 20 are fixedly connected to both ends at the bottom of the first pin holder 16. The second electronic wire 32 is fixedly provided at both ends at the top of the first pin holder 16 and both sides of the inner wall of the first fixing sleeve 33. The first fixing sleeve 33 consists of the second power cord upper pushing cover 22 and the second power cord lower pushing cover 23. One side of the second power cord upper pushing cover 22 is fixedly connected to one end of the second power cord lower pushing cover 23 through a screw. The first fixing sleeve 33 is provided for disassembly.

Preferably, the detachable structure 17 is composed of a conductive piece 44, a second conductive base 31, a third conductive pin 45, two fourth conductive pins 38, a second pin holder 37, and a second fixing sleeve 36. The conductive sheet 44 is fixedly provided at one side of the power cord 12. The second conductive base 31 is fixedly provided at one side of the conductive sheet 44. The third conductive pin 45 is fixedly provided at the top of the second conductive base 31. Both sides at the other end of the third conductive pin 45 are respectively fixedly connected to one end of the two fourth conductive pins 38. The other end of the two fourth conductive pins 38 are respectively fixedly connected to the both ends of the bottom of the second pin holder 37. The second fixing sleeve 36 is rotatably connected to the outer side of the second pin holder 37. The second fixing sleeve 36 is composed of the third power cord upper pushing cover 39 and the third power cord lower pushing cover 40. One side of the third power cord upper pushing cover 39 is fixedly connected to one end of the third power cord lower pushing cover 40 through a screw. One side of the upper handle 2 and one side of the lower handle 1 are provided with a fixed button 42. Both sides of the inner wall of the decorative cover 3 are provided with a fixed fastener 43. A first spring 41 is fixed between the two fasteners 43. The first spring 41 and the fixed fastener 43 are provided to facilitate the user to detach the decorative cover 3.

Preferably, the detachable structure 17 is composed of a tail sleeve 19, a second rotary lock 25, a second spring 26 and a fifth conductive pin 27. The second rotary lock 25 is fixed at one end of the tail sleeve 19. The second rotary lock 25 is fixedly connected to one end of the fifth conductive pin 27 through the second spring 26. A power switch 35 is engaged between the lower handle 1 and the upper handle 2. Both ends of the bottom of the power switch 35 are fixedly connected to both ends at the top of tail contact terminal 4 through the electronic lead 34. A fastening spring 24 is fixed at the connection between the encapsulation 11 and the second rotary lock 25. The conductive copper sleeve 18 is fixed at the connection between the encapsulation 11 and the tail ring 7. The second conductive copper ring 15 is fixed at the internal portion of the conductive copper sleeve 18. The conductive copper sleeve 18 and the second conductive copper ring 15 are provided to enhance conductivity, and the fastening spring 24 is provided to make the structure stably connected.

Preferably, the encapsulation 11 is in a gun shape or a linear shape, and is wound for insulation depending on actual circumstances.

Specific Embodiment 1: On the original basis, the detachable power cord 12 is added with a fixing sleeve (the first power cord upper pushing cover 5 and the first power cord lower pushing cover 6). The fixing sleeve is fastened by screws or ultrasonic-welded. After the combination, the fixing sleeve can be freely rotated smoothly on the rotary head of the power cord 12. There is a fixing slot on the fixing sleeve, which is inserted into the appliance. After rotating the fixing sleeve to the fixing and limiting position, the fastening effect can be achieved. The fixing sleeve is rotated to loose, thereby achieving the detaching effect.

Specific Embodiment 2: The structure of the power cord 12 is provided with the first conductive pin 28, the second conductive pin 20, and the first conductive copper ring 30 thereon. After the power cord 12 is riveted, it is formed by an integral injection molding, and then a rotatable first fixing sleeve 33 (the second power cord upper pushing cover 22 and the second power cord lower pushing cover 23) is added. The first fixing sleeve 33 is fastened by screws or ultrasonic-welded. After the combination, the second fixing sleeve 36 can be freely rotated smoothly on the rotary head of the power cord 12. There is a fixing slot on the first fixing sleeve 33, which is inserted into the appliance. After rotating the fixing lock ring at the tail of the product to the limiting position, the fastening effect can be achieved. The first fixing sleeve 33 is loosened through the rotation of the first rotary lock 21, thereby achieving the detaching effect.

Specific Embodiment 3: The structure of the power cord 12 is provided with the third conductive pin 45 and the fourth conductive pin 38 thereon. After the power cord 12 is riveted, it is formed by an integral injection molding, and then a rotatable second fixing sleeve 36 (the third power cord upper pushing cover 39 and the third power cord lower pushing cover 40) is added. The second fixing sleeve 36 is fastened by screws or ultrasonic-welded. After the combination, the second fixing sleeve 36 can be freely rotated smoothly on the rotary head of the power cord. There is a fixing hole on the second fixing sleeve 36, which is inserted into the appliance. The second fixing sleeve 36 is fastened through the fastener 43 at the tail of the product, such that the fastening effect can be achieved. By pushing the button 42, the fastener 43 is loosened, so that the second fixing sleeve 36 can be pulled out smoothly, thereby achieving the detaching effect.

Specific Embodiment 4: The detachable power cord 12 has an optimized structure on the original basis. The contact pieces inside the tail sleeve 19 are changed to the conductive copper sleeve 18 and the second conductive copper ring 15, so that the energized contact is firmer. After the power cord 12 is riveted, it is formed by an integral injection molding. The fixing elastic ring at the tail of the first-generation product now has an updated structure. The elastic ring is eliminated, the internal structure of the tail sleeve 19 is optimized, the elastic ring parts are reduced, and the assembly process is optimized. By pushing the tail sleeve 19, the internal second rotary lock 25 is opened, the power cord 12 is inserted into the product. The tail sleeve 19 is loosened, and the fixing point inside the tail sleeve 19 returns to the position where the lock is pushed, so that the power cord 12 will not be detached. The tail sleeve 19 is pushed so that the internal rotary lock is opened, and the power cord 12 can be pulled out smoothly, thereby achieving the detaching effect.

Although the present disclosure has been described in detail with reference to the foregoing embodiments, for those skilled in the art, it is still possible for those skilled in the art to modify the technical solutions described in the foregoing embodiments, or make equivalent replacements to some of the technical features. Any modification, equivalent replacement, improvement, etc. made within the spirit and principle of the present disclosure should fall within the protection scope of the present disclosure.

What is claimed is:

1. A novel power cord detachable structure for portable hair curler, comprising a power cord, wherein an encapsulation is fixed to one end of the power cord, an upper handle is fixed to a top of the encapsulation, a lower handle is fixed to a bottom at one side of the encapsulation, a decorative cover is engaged between the lower handle and the upper handle, a CC plug is fixed to the other end of the power cord, one end of the power cord passes through the encapsulation and is fixedly connected to one end of a tail ring, a first electronic wire 14 is fixed at both sides of the tail ring, an outer circular contact piece and a circular pin contact piece are fixed at the both sides of the tail ring, a middle portion at one side of the encapsulation is connected to a detachable structure.

2. The novel power cord detachable structure for portable hair curler according to claim 1, wherein the detachable structure is composed of a first power cord lower pushing cover and a first power cord upper pushing cover, one side of the first power cord upper pushing cover is fixedly connected to the first power cord lower pushing cover through a screw, an internal plug is fixedly configured at the connection between the encapsulation and the tail ring.

3. The novel power cord detachable structure for portable hair curler according to claim 1, wherein the detachable structure consists of a first conductive base, a first conductive pin, a first fixing sleeve, a first rotary lock, two second conductive pins, a first pin holder and four second electronic wires, the first conductive base is fixedly provided at one side of the power cord, a first conductive copper ring is sleeved at the connection between the power cord and the first conductive base, the first conductive pin is fixedly provided at one side of the first conductive base, the first fixing sleeve is rotatably connected to one end of the first conductive pin, the first rotary lock is rotatably connected to one side of the first fixing sleeve, the second conductive pin is fixed at both ends at one side of the first rotary lock, tops of the two second conductive pins are fixedly connected to both ends at a bottom of the first pin holder, a second electronic wire is fixedly provided at both ends at a top of the first pin holder and both sides of an inner wall of the first fixing sleeve, the first fixing sleeve consists of a second power cord upper pushing cover and a second power cord lower pushing cover, one side of the second power cord upper pushing cover is fixedly connected to one end of the second power cord lower pushing cover through a screw.

4. The novel power cord detachable structure for portable hair curler according to claim 1, wherein the detachable structure is composed of a conductive piece, a second conductive base, a third conductive pin, two fourth conductive pins, a second pin holder, and a second fixing sleeve, the conductive sheet is fixedly provided at one side of the power cord, the second conductive base is fixedly provided at one side of the conductive sheet, the third conductive pin is fixedly provided at a top of the second conductive base, both sides at the other end of the third conductive pin are respectively fixedly connected to one end of the two fourth conductive pins, the other end of the two fourth conductive pins are respectively fixedly connected to the both ends of a bottom of the second pin holder, the second fixing sleeve is rotatably connected to an outer side of the second pin holder, the second fixing sleeve is composed of a third power cord upper pushing cover and a third power cord lower pushing cover, one side of the third power cord upper pushing cover is fixedly connected to one end of the third power cord lower pushing cover through a screw, one side of the upper handle and one side of the lower handle are provided with a fixed button, both sides of an inner wall of the decorative cover are provided with a fixed fastener, a first spring is fixed between the two fasteners.

5. The novel power cord detachable structure for portable hair curler according to claim 1, wherein the detachable structure is composed of a tail sleeve, a second rotary lock, a second spring and a fifth conductive pin, the second rotary lock is fixed at one end of the tail sleeve, the second rotary lock is fixedly connected to one end of the fifth conductive pin through the second spring, a power switch is engaged between the lower handle and the upper handle, both ends of a bottom of the power switch are fixedly connected to both ends at a top of a tail contact terminal through an electronic lead, a fastening spring is fixed at the connection between the encapsulation and the second rotary lock, a conductive copper sleeve is fixed at the connection between the encapsulation and the tail ring, a second conductive copper ring is fixed at an internal portion of the conductive copper sleeve.

6. The novel power cord detachable structure for portable hair curler according to claim 1, wherein the encapsulation is in a gun shape or a linear shape.

* * * * *